US008926056B1

(12) United States Patent
Uchino

(10) Patent No.: US 8,926,056 B1
(45) Date of Patent: Jan. 6, 2015

(54) RECORDING APPARATUS, STORAGE MEDIUM STORING INSTRUCTIONS FOR RECORDING APPARATUS, AND CONTROL METHOD

(71) Applicant: Brother Kogyo Kabushiki Kaisha, Nagoya-shi, Aichi-Ken (JP)

(72) Inventor: Shunji Uchino, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/323,227

(22) Filed: Jul. 3, 2014

(30) Foreign Application Priority Data

Sep. 30, 2013 (JP) ..... 2013-204720

(51) Int. Cl.
*B41J 29/393* (2006.01)

(52) U.S. Cl.
CPC ..... *B41J 29/393* (2013.01)
USPC ..... 347/19; 347/105

(58) Field of Classification Search
CPC ..... H04N 1/6033; G03G 15/0131; G03G 2215/0161; B41J 11/46; B41J 13/0009; B41J 13/0027
USPC ..... 347/14, 16, 19, 105, 101
See application file for complete search history.

(56) References Cited

U.S. PATENT DOCUMENTS 7,289,135 B2 * 10/2007 Oku ..... 347/234
8,308,268 B2 * 11/2012 Ikeda et al. ..... 347/19

FOREIGN PATENT DOCUMENTS

JP 2008-173800 7/2008

* cited by examiner

*Primary Examiner* — Thinh Nguyen
(74) *Attorney, Agent, or Firm* — Frommer Lawrence & Haug LLP

(57) ABSTRACT

A recording apparatus includes: a transporting mechanism configured to transport a recording medium along a first transporting path; a recording head configured to record an image on the recording medium transported by the transporting mechanism; a reading unit configured to read the recording medium and arranged upstream of the recording head along the first transporting path; a re-transporting mechanism configured to perform re-transportation of the recording medium to the transporting mechanism in a state that front and back surfaces of the recording medium are inverted, by re-transporting the recording medium to return to an upstream portion of the first transporting path, via a second transporting path; a sensor arranged upstream of the recording head along the first transporting path and configured to detect the recording medium transported by the transporting mechanism; and a controller configured to control the recording head, the reading unit, the transporting mechanism and the re-transporting mechanism.

17 Claims, 6 Drawing Sheets

RECORDING APPARATUS, STORAGE MEDIUM STORING INSTRUCTIONS FOR RECORDING APPARATUS, AND CONTROL METHOD

CROSS REFERENCE TO RELATED APPLICATION

The present application claims priority from Japanese Patent Application No, 2013-204720 filed on Sep. 30, 2013 the disclosure of which is incorporated herein by reference in its entirety.

BACKGROUND OF THE INVENTION

1. Field of the Invention

The present invention relates to a recording apparatus which records an image on a recording medium, a storage medium storing instructions for the recording apparatus, and a control method.

2. Description of the Related Art

Japanese Patent Application Laid-open No. 2.008-173800 describes an image recording apparatus including a medium supplying section which supplies a recording medium, an image recording section which performs recording on the recording medium, a first medium transporting section which transports the recording medium supplied by the medium supplying section to an area facing or opposing to the image recording section, an image reading section arranged between the first medium transporting section and the medium supplying section, a second medium transporting section which returns, to the medium supplying section, the recording medium having the recording performed thereon by the image recording section and which turns over (inverts) the front and back surfaces of the recording medium, and a discharging section which discharges the recording medium. In this image recording apparatus, when inspecting the quality of the image recorded on the recording medium, the recording medium having the image recorded thereon at the image recording section is transported again (re-transported) to the medium supplying section by the second transporting section, the image recorded on the recording medium is read at the image reading section and determination (judgment) is made whether the quality of the recorded image (image quality) is satisfactory or unsatisfactory. In a case that the image quality is unsatisfactory, the recording of image is stopped and an abnormality recovering process, etc., is executed.

In the image recording apparatus described in Japanese Patent Application Laid open No. 2008-173800, the image quality is not judged again even in a case that the image quality is unsatisfactory due to, for example, any deviation in ink discharge timing. In view of this, the inventor of the present teaching considered a configuration for confirming whether or not the image quality is recovered, the inventor found out the following task.

For example, in such a case that a test pattern as an image for inspecting the recording timing (ink discharging timing) is recorded on a recording medium and the quality of the test pattern is judged, the recording medium having the test pattern recorded thereon is re-transported by the second medium transporting section (first re transportation). Then, the test pattern is read at the image reading section and the judgment of the image quality of the test pattern is made, namely, whether the image quality of the test pattern is satisfactory or unsatisfactory is judged. In a case that the image quality is judged to be unsatisfactory, a re-test pattern which is affected by any correction of the discharge timing is recorded on the recording medium, and the quality of the re-test pattern is judged. Here, the following case is considered wherein the re-test pattern is to be recorded on the recording medium on which the test pattern has been recorded. In such a case, after the test pattern on the recording medium is read at the image reading section, the recording medium passes through the image recording section without having the re-test pattern being recorded thereon, and the recording medium is re transported by the second transporting section (second re-transportation). Then, after the image of the re-test pattern is recorded on the recording medium by the image recording section, the recording medium is re-transported by the second transporting section (third re-transportation); and by reading the image of the re-test pattern by the image reading section, the judgment of the image quality of the recorded re-test pattern is performed. In such a manner, it is possible to confirm whether or not the lowering in image quality due to the deviation in the ink discharge timing is recovered, while causing a such problem that since the recording medium is re-transported as many as three times by the second transporting section, an inspection time required for confirming whether or not the image quality has been recovered becomes long. Note that in a case of recording the re-test pattern on a new recording medium, the re-transporting of recording medium (recording media) by the second transporting section is performed substantially twice, which in turn shortens the inspection time, but causes another problem that another recording medium has to be consumed.

SUMMARY OF THE INVENTION in view of the above-described situation, an object of the present teaching is to provide a recording apparatus, a storage medium storing instructions for the recording apparatus, and a control method capable of shortening the inspection time without consuming another recording medium.

According to a first aspect of the present teaching, there is provided a recording apparatus including: a transporting mechanism configured to transport a recording medium along a first transporting path; a recording head configured to record an image on the recording medium which is transported by the transporting mechanism; a reading unit which is configured to read the recording medium and which is arranged upstream of the recording head along the first transporting path and on a side opposite to the recording head, with the first transporting path intervened between the reading unit and the recording head; a re-transporting mechanism configured to re-transport the recording medium to return to an upstream portion of the first transporting path located upstream of the reading unit with a rear end, of the recording medium which has been transported by the transporting mechanism to a downstream portion of the first transporting path located downstream of the recording head, as a forward end in the re-transportation, via a second transporting path different from the first transporting path, thereby performing re transportation of the recording medium to an upstream portion, of the transporting mechanism, located upstream of the reading unit in a state that front and back surfaces of the recording medium are inverted; a sensor arranged upstream of the recording head along the first transporting path and configured to detect a forward end of the recording medium which is transported by the transporting mechanism; and a controller configured to control the recording head, the reading unit, the transporting mechanism and the re-transporting mechanism, wherein the controller is configured to execute: a test pattern recording process in which a test pattern is recorded on a first surface of the recording medium based on a detection timing at which the sensor detects the forward end of the recording medium by controlling the transporting mechanism and the recording head; a first reading process, in which the recording medium having the test pattern recorded on the first surface thereof is re-transported to the reading unit by controlling the re-transporting mechanism and the transporting mechanism and the first surface on which the test pattern has been recorded is read by controlling the reading unit; a re-test pattern recording process, in which a re-test pattern is recorded by controlling the transporting mechanism and the recording head, at a recording corrected based on a reading data read in the first reading process, on a second surface on a side opposite to the first surface of the recording medium based on the detection timing, before the recording medium which has been read in the first reading process completely passes beyond the recording head for a first time after the first reading process; and a second reading process, in which the recording medium having the re-test pattern recorded on the second surface thereof is re-transported by controlling the re transporting mechanism and the transporting mechanism and the second surface on which the re-test pattern has been recorded is read by controlling the reading unit.

According to a second aspect of the present teaching, there is provided a storage medium storing a computer-executable instructions that, when executed by a processor of a computer, cause a recording apparatus to execute the following processes, the recording apparatus including: a transporting mechanism configured to transport a recording medium along a first transporting path; a recording head configured to record an image on the recording medium which is transported by the transporting mechanism; a reading unit which is configured to read the recording medium and which is arranged upstream of the recording head along the first transporting path and on a side opposite to the recording head, with the first transporting path intervened between the reading unit and the recording head; a re-transporting mechanism configured to re-transport the recording medium to return to an upstream portion of the first transporting path located upstream of the reading unit with a rear end, of the recording medium which has been transported by the transporting mechanism to a downstream portion of the first transporting path located downstream of the recording head, as a forward end in the re-transportation, via a second transporting path different from the first transporting path, thereby performing re transportation of the recording medium to an upstream portion, of the transporting mechanism, located upstream of the reading unit in a state that front and back surfaces of the recording medium are inverted; and a sensor arranged upstream of the recording head along the first transporting path and configured to detect a forward end of the recording medium which is transported by the transporting mechanism, the processes which the recording apparatus is caused to execute by the instruction including: a test pattern recording process in which a test pattern is recorded on a first surface of the recording medium based on a detection timing at which the sensor detects the forward end of the recording medium by controlling the transporting mechanism and the recording head; a first reading process, in which the recording medium having the test pattern recorded on the first surface thereof is re-transported to the reading unit by controlling the re-transporting mechanism and the transporting mechanism and the first surface on which the test pattern has been recorded is read by controlling the reading unit; a re-test pattern recording process, in which a re-test pattern is recorded by controlling the transporting mechanism and the recording head, at a recording timing corrected based on a reading data read in the first reading process, on a second surface on a side opposite to the first surface of the recording medium based on the detection timing, before the recording medium which has been read in the first reading process completely passes beyond the recording head for a first time after the first reading process; and a second reading process, in which the recording medium having the re-test pattern recorded on the second surface thereof is re-transported by controlling the re-transporting mechanism and the transporting mechanism and the second surface on which the re-test pattern has been recorded is read by controlling the reading unit.

According to a third aspect of the present teaching, there is provided a control method for controlling a recording apparatus including: a transporting mechanism configured to transport a recording medium along a first transporting path; a recording head configured to record an image on the recording medium which is transported by the transporting mechanism; a reading unit which is configured to read the recording medium and which is arranged upstream of the recording head along the first transporting path and on a side opposite to the recording head, with the first transporting path intervened between the reading unit and the recording head; a re-transporting mechanism configured to re-transport the recording medium to return to an upstream portion of the first transporting path located upstream of the reading unit with a rear end, of the recording medium which has been transported by the transporting mechanism to a downstream portion of the first transporting path located downstream of the recording head, as a forward end in the re-transportation, via a second transporting path different from the first transporting path, thereby performing re-transportation of the recording medium to an upstream portion, of the transporting mechanism, located upstream of the reading unit in a state that front and back surfaces of the recording medium are inverted; and a sensor arranged upstream of the recording head along the first transporting path and configured to detect a forward end of the recording medium which is transported by the transporting mechanism, the control method including: controlling the transporting mechanism and the recording head to record a test pattern on a first surface of the recording medium based on a detection timing at which the sensor detects the forward end of the recording medium; controlling the re-transporting mechanism and the transporting mechanism to re-transport the recording medium haying the test pattern recorded on the first surface thereof to the reading unit and controlling the reading unit to read the first surface on which the test pattern has been recorded; controlling the transporting mechanism and the recording head to record a re-test pattern at a recording timing corrected based on a reading data read by the reading unit, on a second surface on a side opposite to the first surface of the recording medium based on the detection timing, before the recording medium which has been read by the reading unit completely passes beyond the recording head for a first time after having been read by the reading unit; and controlling the re-transporting mechanism and the transporting mechanism to re-transport the recording medium having the re-test pattern recorded on the second surface thereof and controlling the reading unit to read the second surface on which the re-test pattern has been recorded.

According to the recording apparatus, the storage medium and the control method of the present teaching, the re-test pattern is recorded on the second surface of the recording medium, which has been read in the first recording process, before the recording medium completely passes beyond the recording head for the first time after the first reading process. With this, even using the recording medium having the test pattern recorded thereon, the number of times for re-transporting the recording medium for inspecting the recording timing is twice, thereby shortening the inspection time.

DESCRIPTION OF THE PREFERRED EMBODIMENTS

Figure 1:
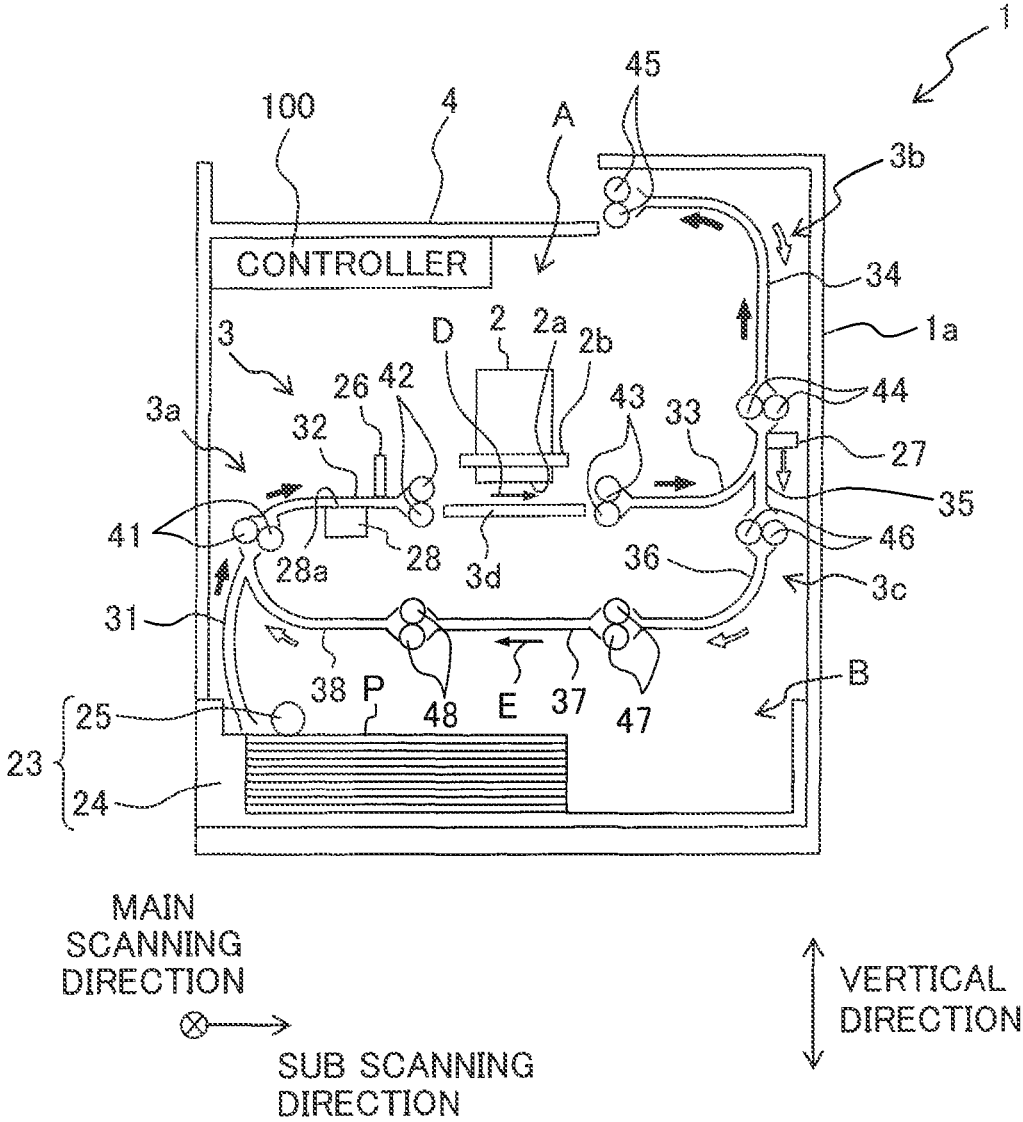
FIG. 1 is a schematic side view showing the inner configuration of an ink-jet printer according to an embodiment of a recording apparatus of the present teaching.

In the following, a preferred embodiment of the present teaching will be explained with reference to the drawings.

At first, the entire configuration of an ink-jet printer 1 (hereinafter referred to as the "printer 1" as appropriate) as an embodiment of recording apparatus according to the present teaching will be explained with reference to FIG. 1.

The printer 1 has a casing 1*a* having a shape of rectangular parallelepiped. A paper sheet discharge section 4 configured to discharge a paper (paper sheet) P is provided at an upper portion of the top plate of the casing 1*a*. The inner space inside the casing 1*a* can be divided into a space A and a space B in this order from above. A paper sheet transporting path and a paper sheet re-transporting path are formed in the space A and the space B, wherein the paper sheet transporting path is directed from a paper sheet feeding section 23 to the paper sheet discharging section 4, and the paper sheet re-transporting path is directed from the downstream side to the upstream side of the paper sheet transporting path. As shown in FIG. 1, the paper sheet P is transported along black thick arrows in the paper sheet transporting path, and the paper sheet P is transported along white thick arrows in the paper sheet re-transporting path. In the space A, image recording for recoding an image on the paper sheet P, transportation of the paper sheet P to the paper sheet discharging section 4, and the re-transportation of the paper sheet P are performed. The feeding of the paper sheet P from the paper sheet feeding section 23 to the paper sheet transporting path is performed in the space B.

A head 2 which discharges a black ink, a transporting device 3 which transports the paper sheet P, two paper sheet sensors 26, 27, an image sensor 28, a controller 100, etc. are arranged in the space A. Further, a cartridge (not shown in the drawings) is installed in the space A. The black ink is stored in this cartridge. The cartridge is connected to the head 2 via a tube and a pump (both of which are not shown in the drawings) to supply the black ink to the head 2.

The head 2 is a line head having a substantially rectangular parallelepiped shape that is elongated in a main scanning direction. The lower surface of the head 2 is a discharge surface 2*a* on which a large number of discharge ports 2*a*1 (see FIG. 3A) are arranged in the main scanning direction at a spacing distance of 600 dpi. When performing recording, the black ink is discharged from the discharge ports 2*a*1 of the discharge surface 2*a*. The head 2 is supported by the easing 1*a* via a head holder 2*b*. The head holder 2*b* supports the head 2 such that a predetermined gap suitable for recording is defined between the discharge surface 2*a* and a platen 3*d* (to be described later on).

Figure 2:
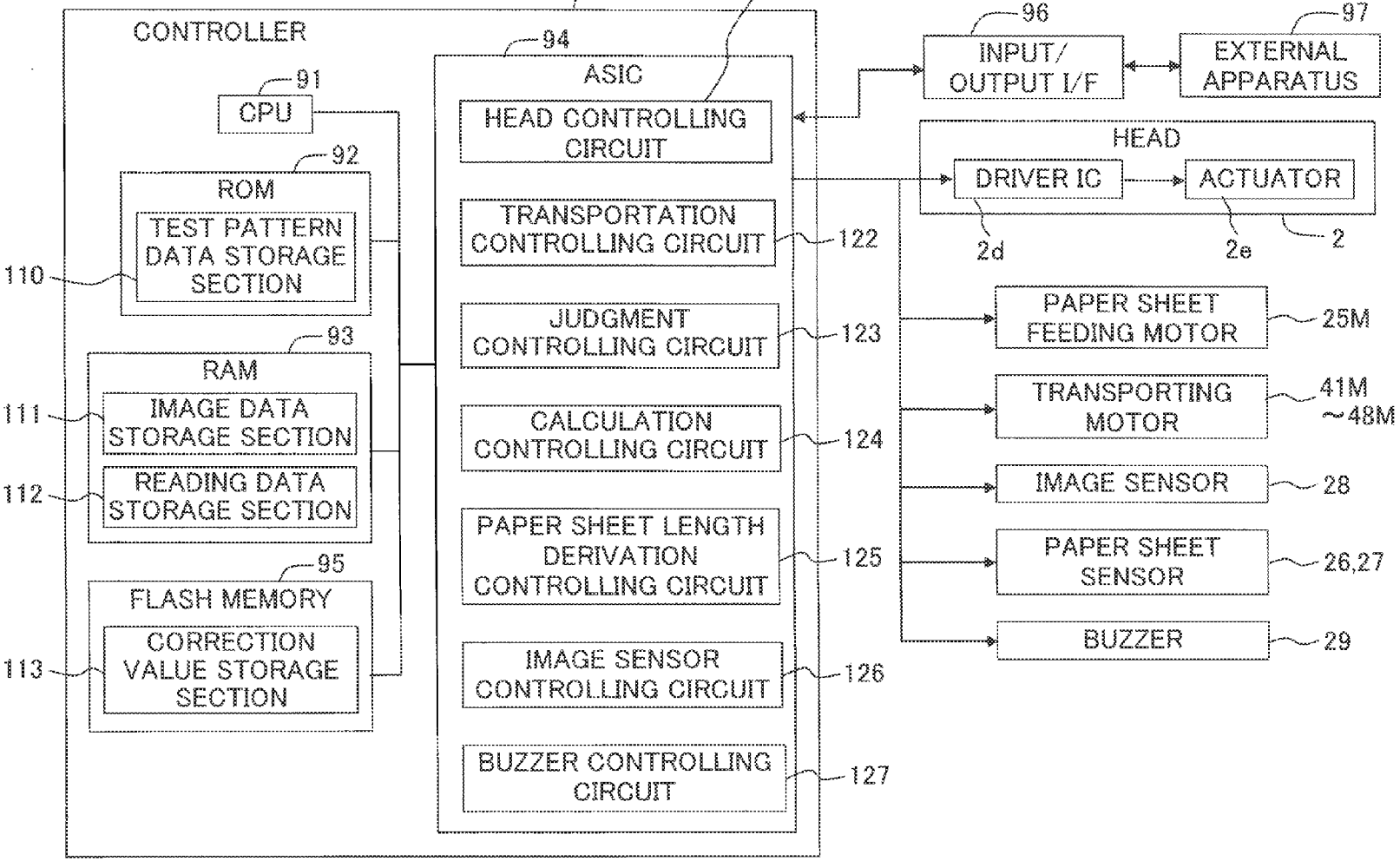
FIG. 2 is a block diagram showing the electrical configuration of the ink-jet printer.

The head 2 includes a flow passage member, an energy imparting section and a driver IC 2*d* (see FIG. 2). Flow passages reaching to the discharge ports 2*a*1, respectively, are formed in the flow passage member. The energy imparting section imparts the energy to the ink in the flow passages so that the ink is discharged from the discharge ports 2*a*1. In this embodiment, an actuator 2*e* (see FIG. 2) of the piezoelectric system using piezoelectric elements is used as the energy imparting section. The actuator 2*e* is connected to the controller 100 via a wiring member on which the driver IC 2*d* is mounted (for example, a flexible printed circuit: FPC). The actuator 2*e* is driven when a predetermined electric potential is applied to the actuator 2*e* from the driver IC 2*d* under the control of the controller 100.

The transporting device 3 has an upstream guide portion 3*a*, a downstream guide portion 3*b*, a re-transporting guide portion 3*c* and a platen 3*d*. The platen 3*d* is arranged at a position facing or opposing the discharge surface 2*a* of the head 2. The platen 3*d* has a flat upper surface, supports the paper sheet P from below and defines a recording area (a portion of the paper sheet transporting path) between the platen 3*d* and the discharge surface 2*a*. The upstream guide portion 3*a* and the downstream guide portion 3*b* are arranged with the platen 3*d* intervening therebetween. The upstream guide portion 3*a* has two guides 31 and 32 and two pairs of transporting rollers 41 and 42, and connects the recording area (between the platen 3*d* and the head 2) and the paper sheet feeding section 23. The two pairs of transporting rollers 41 and 42 are rotated when transporting motors 41M and 42M (see FIG. 2) are driven under the control of the controller 100, and transport the paper sheet P toward the recording area.

The downstream guide portion 3*b* has two guides 33 and 34 and three pairs of transporting rollers 43 to 45, and connects the recording area and the paper sheet discharging section 4. The three pairs of transporting rollers 43 to 45 are rotated when transporting motors 43M to 45M (see FIG. 2) are driven under the control of the controller 100, and transport the paper sheet P toward the paper sheet discharging section 4. The paper sheet transporting path (first transporting path) is defined by the four guides 31 to 34, the platen 3*d* and the head 2. Further, a transporting mechanism, which transports the paper sheet P from the paper sheet feeding section 23 to the paper sheet discharging section 4, is constructed by the upstream guide portion 3*a* and the downstream guide portion 3*b*.

The re-transporting guide portion 3*c* has four guides 35 to 38 and three pairs of transporting rollers 46 to 48, and connects the upstream guide portion 3*a* and the downstream guide portion 3*b* while bypassing the recording area. The guide 35 is connected to an intermediate portion of the guide 33 and connects the re-transporting guide portion 3*c* and the downstream guide portion 3*b*. The guide 38 is connected to a portion, located at an intermediate position in the guide 31 and upstream of the image sensor 28 along the paper sheet transporting path, and connects the re-transporting guide portion 3*c* and the upstream guide portion 3*a*. A paper sheet re-transporting path (second transporting path) is defined by the four guides 35 to 38. The three pairs of transporting rollers 46 to 48 are arranged in this order respectively between two adjacent guides among the guides 35 to 38. Further, the three pairs of transporting rollers 46 to 48 are rotated when transporting motors 46M to 48M (see FIG. 2) are driven under the control of the controller 100, and transport the paper sheet P toward the upstream guide portion 3*a*.

Note that the pair of transporting rollers 44 switches the transporting direction of the paper sheet P under the control of the controller 100. Namely, when the paper sheet P is transported from the recording area to the paper sheet discharging section 4, the pair of transporting rollers 44 is rotated such that the paper sheet P is transported upward. On the other hand, in a case that the paper sheet P is re-transported (in a ease that the paper sheet P is transported from the paper sheet transporting path to the paper sheet re-transporting path), the rotational direction of the pair of transporting rollers 44 is switched such that the paper sheet P is transported downward, with the rear end of the paper sheet P as the forward end (leading end) in the re-transportation, under a condition that the paper sheet sensor 27 detects that the rear end of the paper sheet P is located between the pair of transporting rollers 44 and a connection location at which the guides 33 and 35 are connected to each other. The paper sheet P, which has been transported from the paper sheet transporting path to the paper sheet re-transporting path, is re-transported to the upstream guide portion 3*a*. At this time, the paper sheet P is transported again (is re transported) to the recording area in a state that the front and back surfaces of the paper sheet P are inverted from the previous state of the front and back surfaces when the paper sheet P has passed through the recording area immediately before being re-transported to the recording area again. With this, it is possible to perform recording on the both surfaces of the paper sheet P. In such a mariner, the re-transporting mechanism is constructed by the re-transporting guide portion 3*c* and the pair of transporting rollers 44.

The paper sheet feeding section 23 is arranged in the space B. The paper sheet feeding section 23 has a paper sheet feeding tray 24 and a paper sheet feeding roller 25. Among these, the paper sheet feeding tray 24 is configured to be detachable with respect to the casing 1*a*. The paper sheet feeding tray 24 is a box which is open at an upper portion thereof, and is capable of accommodating a plurality of pieces of the paper sheet P. The paper sheet feeding roller 25 is rotated when a paper sheet feeding motor 25M (see FIG. 2) is driven under the control of the controller 100, and feeds out an uppermost paper sheet P, located at the top of the plurality of pieces of the paper sheet P accommodated in the paper sheet feeding tray 24, to the guide 31.

Here, in FIG. 1, a "sub scanning direction" indicates a direction parallel to a paper sheet transporting direction 1) in which the paper sheet P is transported by the pairs of transporting rollers 42 and 43 and parallel to a paper sheet transporting direction E in which the paper sheet P is transported by the pair of transporting roller 47; and a "main scanning direction" indicates a direction parallel to a horizontal plane and orthogonal to the sub scanning direction.

The paper sheet sensor 26 is arranged between the head 2 and the image sensor 28 along the paper sheet transporting path, and detects the forward end of the paper sheet P which has been transported up to the paper sheet sensor 26. When the paper sheet sensor 26 detects the forward end of the paper sheet P, the paper sheet sensor 26 outputs a signal to the controller 100. The paper sheet sensor 27 is arranged, along the paper sheet transporting path, between the pair of transporting rollers 44 and the connection location at which the guides 33 and 35 are connected to each other, and detects the rear end of the paper sheet P which is being transported. When the paper sheet sensor 27 detects the rear end of the paper sheet P, the paper sheet sensor 27 outputs a signal to the controller 100.

The image sensor (reading unit) 28 is arranged upstream of the paper sheet sensor 26 along the paper sheet transporting path and on the side opposite to the head 2, with the paper sheet transporting path intervened between the image sensor 28 and the head 2. Namely, the head 2 is arranged at a location at which the discharge surface 2*a* of the head 2 faces or opposes the upper surface of the paper sheet P, and the image sensor 28 is arranged at a position at which a detection surface 28*a* of the image sensor 28 faces or opposes the lower surface of the paper sheet P. Further, the image sensor 28 is a line sensor having a detection area of which width is substantially same as the width of the paper sheet P. A plurality of sensor elements are arranged on the detection surface 28*a* to be aligned in the main scanning direction. With this configuration, the image sensor 28 is capable of reading the maximum width of the image at least in the main scanning direction and is capable of reading the paper sheet P across the entire length thereof with respect to the transporting direction. Each of the sensor elements has a light emitting section configured to emit a light onto the paper sheet P based on the control by the controller 100 and a light receiving section configured to receive the light reflected from the paper sheet P. The image sensor 28 outputs a light reception amount of the light reflected from the paper sheet P and detected by each of the light receiving sections to the controller 100 as a reading data. Further, in the main scanning direction, the spacing distance between the sensor elements is same as the spacing distance between the discharge ports 2*a*1 of the head 2. Namely, the image sensor 28 is capable of reading the image formed on the paper sheet P at a resolution same as the print resolution of the head 2 in the main scanning direction. Thus, the image sensor 28 is capable of performing detection at every one dot-area on which the ink discharged from the head 2 has landed.

The controller 100 controls the operations of respective sections or parts of the printer 1 to thereby manage the entire operation of the printer 1 as a whole. The controller 100 controls an image recording operation based on an image data (recording command) supplied from an external apparatus 97 (such as a personal computer (PC) connected to the printer 1, see FIG. 2). Specifically, the controller 100 controls the supply/transportation/discharge operations of the paper sheet P, an ink discharge operation synchronized with the transportation of the paper sheet P, and the like. Further, the controller 100 executes a discharge inspection to inspect whether or not the ink is discharged at a desired position on the transported paper sheet P based on a discharge inspection command from the external apparatus 97. The specifics of the discharge inspection will be described later on.

For example, in a case that the controller 100 receives a recording command from the external apparatus 97 to perform recording on one surface of the paper sheet P, the controller 100 drives the paper sheet feeding section 23 and the pairs of transporting rollers 41 to 45 based on this recording command. The paper sheet P, fed out from the paper sheet feeding tray 24, is guided by the upstream guide portion 3*a* and is transported to the recording area (between the platen 3*d* and the head 2). When the paper sheet P is passing immediately below the head 2, the head 2 is controlled by the controller 100 such that droplets of the ink (ink droplets) are discharged from the head 2. With this, a desired image is recorded on a first surface P1 (front surface, see FIG. 3A) of the paper sheet P. The ink discharging operation (ink discharge timing) is based on a detection signal from the paper sheet sensor 26. Further, the paper sheet P having the image recorded thereon is guided by the downstream guide portion 3*b* and is discharged to the paper sheet discharging section 4 from the upper portion of the casing 1*a*.

On the other hand, for example, in a case that the controller 100 receives a recording command from the external apparatus 97 to perform recording on both surfaces of the paper sheet P, the controller 100 drives the paper sheet feeding section 23 and the pairs of transporting rollers 41 to 45 based on this recording command. At first, an image is formed on one surface of the paper sheet P in a similar manner as that in the case of performing recording on one surface, and then the paper sheet P is transported toward the paper sheet discharging section 4. As shown in FIG. 1, the paper sheet sensor 27 is arranged in the downstream guide portion 3*b* at a location in the vicinity of the upstream of the pair of transporting rollers 44. When the paper sheet sensor 27 detects the rear end of the paper sheet P, the pair of transporting rollers 44 is reversely rotated (counter-rotated) under the control of the controller 100 so as to reverse the transporting direction of the paper sheet P. At this time, the paper sheet P has not yet reached to the pair of transporting rollers 45. In other words, a spacing distance between the pairs of transporting rollers 44 and 45 along the paper sheet transporting path is substantially same as the length of the paper sheet P, and is such a distance that when the forward end of the paper sheet P reaches the pair of transporting rollers 45, the rear end of the paper sheet P reaches the pair of transporting rollers 44. Further, at this time, the pairs of transporting rollers 46 to 48 are driven. With this, the transporting path is switched such that the paper sheet P is transported along the paper sheet re-transporting path (path indicated by white-solid arrows). The paper sheet P re-transported to the upstream guide portion 3*a* from the paper sheet re-transporting path is re-supplied (supplied again) to the recording area in a state that the front and back surfaces of the paper sheet P are inverted, and an image is recorded on a second surface P2 (back surface, see FIG. 3C) of the paper sheet P. Note that, when the forward end of the paper sheet P is detected by the paper sheet sensor 26 prior to the image recording on the second surface P2, the rotational direction of the pair of transporting rollers 44 is returned to the normal direction. The paper sheet P having the images recorded on the both surfaces, respectively, is discharged to the paper sheet discharging section 4 via the downstream guide portion 3*b*.

Next, the electrical configuration of the printer 1 will be explained with reference to FIG. 2.

The controller 100 includes a CPU (Central Processing Unit) 91, a ROM (Read Only Memory) 92, a RAM (Random Access Memory) 93, an ASIC (Application Specific Integrated Circuit) 94, a flash memory 95, a timer, etc. The ROM 92 stores a program executed by the CPU 91, a variety of kinds of fixed data, a test pattern data, etc. Namely, the ROM 92 includes a test pattern data storage section 110. The RAM 93 temporarily stores data necessary for executing program (image data, reading data, etc.). Namely, the RAM 93 includes an image data storage section 111 and a reading data storage section 112. The ASIC 94 includes a head controlling circuit 121, a transportation controlling circuit 122, a judgment controlling circuit 123, a calculation controlling circuit 124, a paper sheet length derivation controlling circuit 125, an image sensor controlling circuit 126 and a buzzer controlling circuit 127. Further, the ASIC 94 is connected to the external apparatus 97, via an input/output 11F (interface) 96 such that data communication can be performed between the ASIC 94 and the external apparatus 97. The flash memory 95 is a non-volatile memory and includes a correction value storage section 113 which stores a correction value (to be described later on) calculated by the calculation controlling circuit 124. The controller 100 is connected also to the paper sheet feeding motor 25M, the transporting motors 41M to 48M, the paper sheet sensors 26 and 27, the image sensor 28, a buzzer 29, the head 2, etc., as shown in FIG. 2.

Note that although one piece of the CPU 91 performs the processing operations relating to the respective controls in this embodiment, there is no limitation to this. For example, it is also allowable to provide an aspect wherein a plurality of pieces of CPU are assigned with the processing operations relating to the respective controls, an aspect wherein an ASIC performs the processing operations relating to the respective controls, an aspect wherein one CPU or a plurality of CPUs cooperate(s) with one ASIC or a plurality of ASICs to perform the processing operations relating to the respective controls, and the like.

Figure 3A:
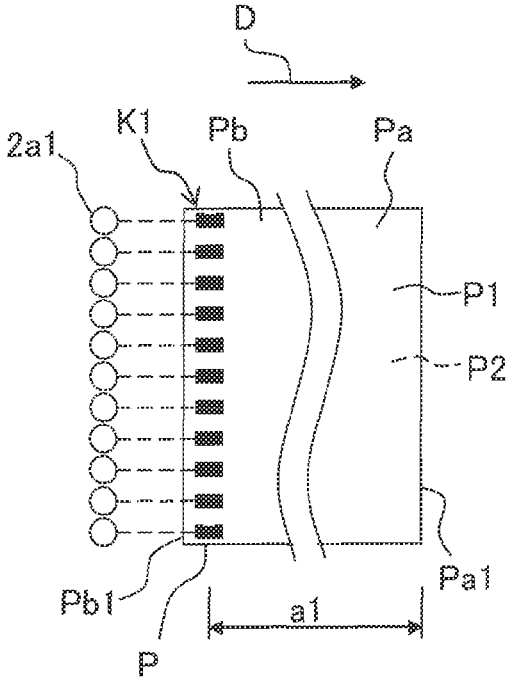
FIGS. 3A to 3D are schematic views showing a test pattern and a re-test pattern to be recorded on a paper (paper sheet) in a discharge inspection executed by a controller of the ink-jet printer shown in FIG. 1.
Figure 3B:
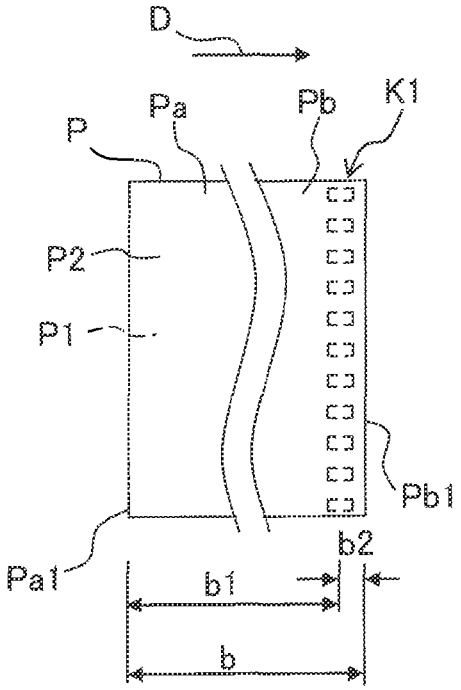
Figure 3C:
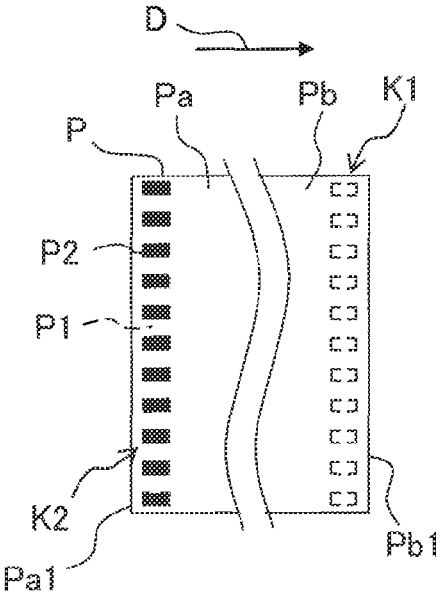

The test pattern data storage section 110 stores a predetermined test pattern data. A test pattern K1 which is recorded based on the test pattern data in this embodiment is formed at a desired position on the paper sheet P by discharging the ink at the same time from all the discharge ports 21*a* at a predetermined discharge timing after the forward end of the paper sheet P has been detected at the paper sheet sensor 26. Note that the predetermined discharge timing (recording timing) is set such that a distance from a first side Pa1 (a side of the paper sheet P located on the downstream end in the transporting direction in a state that the first surface P1 of the paper sheet P faces the discharge surface 2*a*) to the test pattern K1 becomes a set distance a1 as shown in FIG. 3A, after the forward end of the paper sheet P transported at a predetermined velocity has been detected by the paper sheet sensor 26. Further, in a case that the paper sheet P (in a state that the first surface P1 faces the discharge surface 2*a*) is divided into a first portion Pb on the upstream side of a central portion and a second portion Pa on the downstream side of the central portion along the paper sheet transporting path, the predetermined discharge timing is set to be such a timing that the test pattern K1 is formed in the vicinity of a second side Pb1 (which is parallel to the first side Pa1 and is located farthest from the first side Pa1) of the first portion Pb. The test pattern K1 is composed of a plurality of linear patterns which are aligned in the main scanning direction at a regular spacing distance same as that of the discharge ports 2*a*1. Each of the linear patterns extends along the paper sheet transporting path. Note that since the re-test pattern K2 shown in FIG. 3C has a discharge timing with respect to the paper sheet P which is different from that of the test pattern K1, the re-test pattern K2 is formed at a position, on the paper sheet P, which is different to some extent as that of the test pattern K1. However, the shape, etc. of the respective linear patterns of the re-test pattern K2 is same as that of the test pattern K1. Further, the re-test pattern K2 is formed on the second surface P2 of the paper sheet P at a location in the vicinity of the first side Pa1 of the second portion Pa in the paper sheet P, as shown in FIG. 3C. As described above, although each of the test pattern K1 and the re-test pattern K2 is formed in the vicinity of the rear end of the paper sheet P, the test pattern K1 and the re-test pattern K2 are formed in different portions in the first portion Pb and the second portion Pa, respectively, in the paper sheet P, in order that, as will be described later on, the paper sheet P having the test pattern K1 formed thereon is re-transported with the rear end of the paper sheet P as the forward end of the re-transportation, and that the re-test pattern K2 is formed on the paper sheet P in the state that the front and back surfaces thereof are inverted.

The image data storage section 111 stores an image data from the external apparatus 97. The head controlling circuit 121 controls the driver IC 2*d* based on the image data and the test pattern data. Further, the head controlling circuit 121 generates a corrected image data and a re-test pattern data in which correction values are considered with respect to the image data and the test pattern data, respectively, and the head controlling circuit 121 controls the driver IC 2*d* based on the corrected image data and the re-test pattern data. Note that the corrected image data and the re-test pattern data are generated in the following manner. Namely, in a condition that a correction value is stored in the correction value storage section 113 when the recording operation is executed based on either one of the recording command and the discharge inspection command, the head controlling circuit 121 generates the corrected image data and the re-test pattern data by causing the correction value to affect the predetermined discharge timing for each of the image data and the test pattern data. Here, the term "predetermined discharge timing" corresponds to a period of time from a point of time when the forward end of the paper sheet P which is being transported at a predetermined velocity is detected by the paper sensor 26 and until a point of time when a position at which the image P (including the test pattern) is to be formed on the paper sheet P faces or opposes the discharge ports 2*a*1.

The transportation controlling circuit 122 controls the paper sheet feeding motor 25M and the transporting motors 41M to 48M, based on either one of the recording command and the discharge inspection command, such that the paper sheet p is transported along the transporting direction at the predetermined velocity.

The image sensor controlling circuit 126 controls the image sensor 28 (the light emitting section and the light receiving section) in the transportation of the paper sheet P when recording the test pattern K1 so as to read the entirety of the paper sheet P. Further, the image sensor controlling circuit 126 controls the image sensor 28 in the re transportation of the paper sheet P, having the test pattern K1 recorded thereon, so as to read an area, of the paper sheet P, spanning from the second side Pb1 up to the test pattern K1. Further, the image sensor controlling circuit 126 controls the image sensor 28 in the re-transportation of the paper sheet. P, having the re-test pattern K2 recorded thereon, so as to read an area, of the paper sheet P, spanning from the first side Pa1 up to the re-test pattern K2.

The reading data storage section 112 stores a first reading data obtained by reading the entirety of the paper sheet P with the image sensor 28, a second reading data obtained by reading the area of the paper sheet P spanning from the second side Pb1 up to the test pattern K1, and a third reading data obtained by reading the area of the paper sheet P spanning from the first side Pa1 up to the re-test pattern K2.

The paper sheet length derivation controlling circuit 125 derives an entire length "b" (see FIG. 3B) of the paper sheet P along the paper sheet transporting path, based on the first reading data. The calculation controlling circuit 124 calculates a first inspection distance "b1" (see FIG. 3B) from the first side Pa1 of the paper sheet P up to the test pattern K1, based on the second reading data. More specifically, the calculation controlling circuit 124 derives a distance "b2" from the second side Pb1 of the paper sheet P up to the test pattern K1, based on the second reading data, and calculates the first inspection distance b1 by subtracting the distance b2 from the entire length b derived by the paper sheet length derivation controlling circuit 125. Further, the calculation controlling circuit 124 calculates a second inspection distance "c1" (see FIG. 3D) from the second side Pb1 of the paper sheet P up to the re-test pattern K2, based on the third reading data. More specifically, the calculation controlling circuit 124 derives a distance "c2" from the first side Pa1 of the paper sheet P up to the re-test pattern K2, based on the third reading data, and calculates the second inspection distance c1 by subtracting the distance c2 from the entire length b derived by the paper sheet length derivation controlling circuit 125.

The judgment controlling circuit 123 judges whether or not the first inspection distance b1 is same as the set distance a1, and judges whether or not the position of the test pattern K1 based on the second reading data coincides with the desired position (position determined by the predetermined discharge timing based on the detection timing of the paper sheet P with the paper sheet sensor 26). Further, the judgment controlling circuit 123 also judges whether or not the first inspection distance b1 is greater than the set distance a1. In a case that the first inspection distance b1 is judged by the judgment controlling circuit 123 to be greater than the set distance a1, the calculation controlling circuit 124 calculates a correction value for quickening the discharge timing. Namely, the time as the correction value is calculated by dividing the distance, obtained by subtracting the set distance a1 from the first inspection distance b1, by a predetermined transporting velocity. At this time, the calculated time is stored in the correction value storage section 113 as a negative correction value. On the other hand, in a case that the first inspection distance b1 is judged by the judgment controlling circuit 123 to be smaller than the set distance a1, the calculation controlling circuit 124 calculates a correction value for delaying the discharge timing. Namely, the time as the correction value is calculated by dividing the distance, obtained by subtracting the first inspection distance b1 from the set distance a1, by the predetermined transporting velocity. At this time, the calculated time is stored in the correction value storage section 113 as a positive correction value.

Furthermore, the judgment controlling circuit 123 judges whether or not the second inspection distance c1 is same as the set distance a1, and judges whether or not the position of the re-test pattern K2 based on the third reading data coincides with the desired position. In a case that the position of the re-test pattern K2 based on the third reading data does not coincide with the desired position, the buzzer controlling circuit 127 controls the buzzer 29 so as to notify the user of transportation abnormality.

Figure 3D:
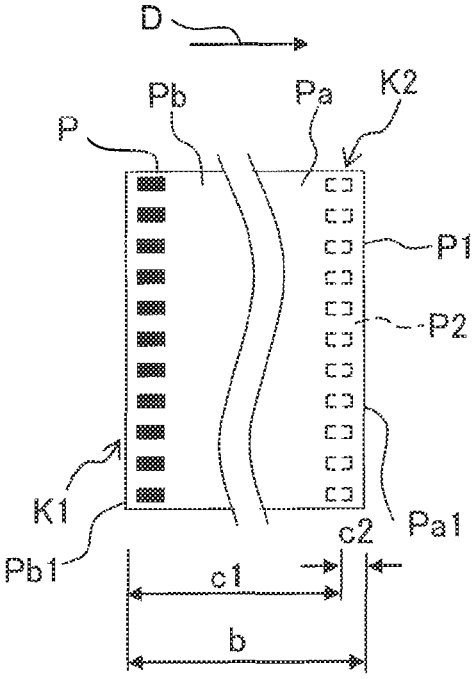
Figure 4A:
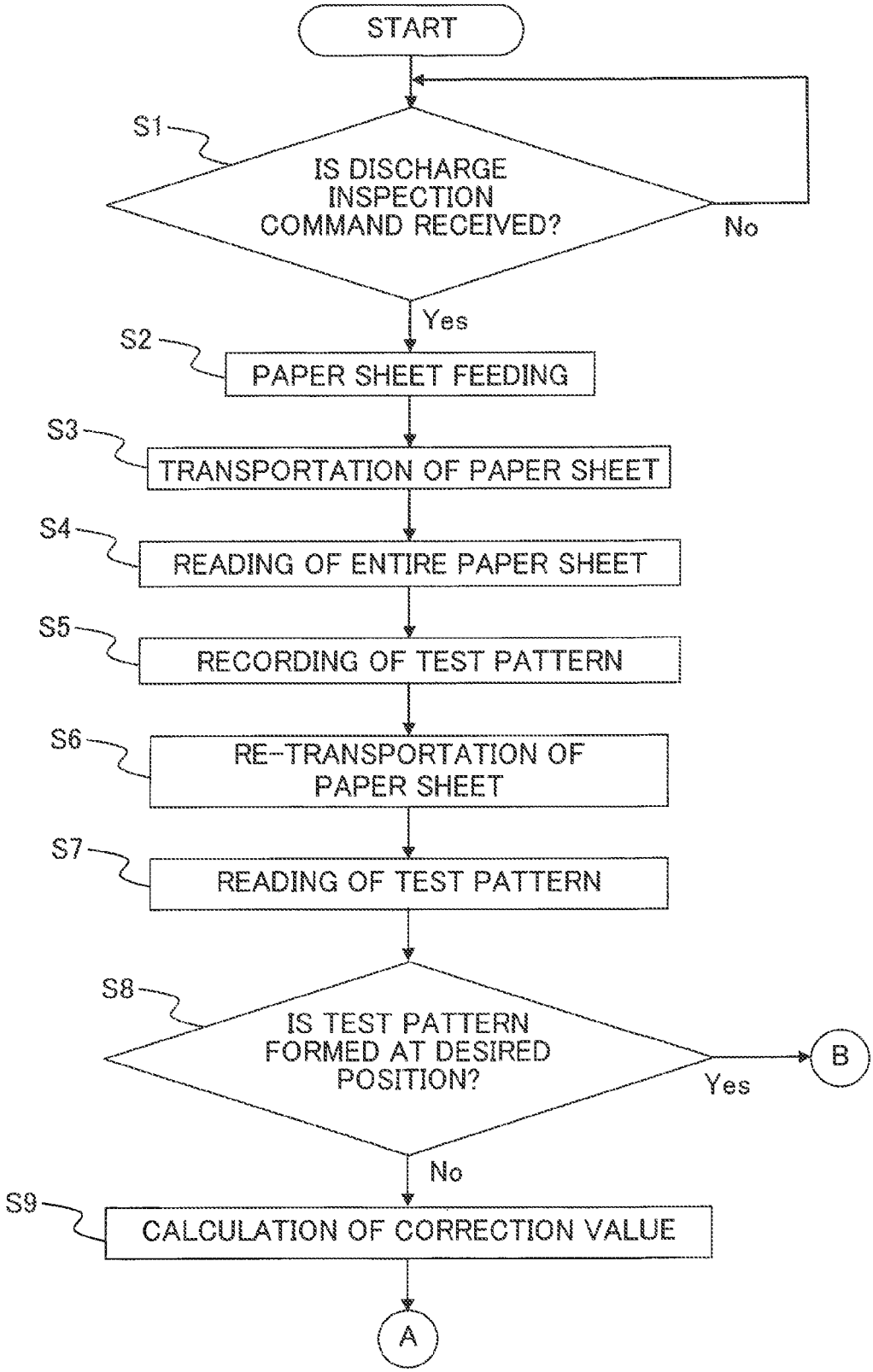
FIGS. 4A and 4B show a flow chart showing the control flow according to discharge inspection executed by the controller of the ink-jet printer shown in FIG. 1.
Figure 4B:
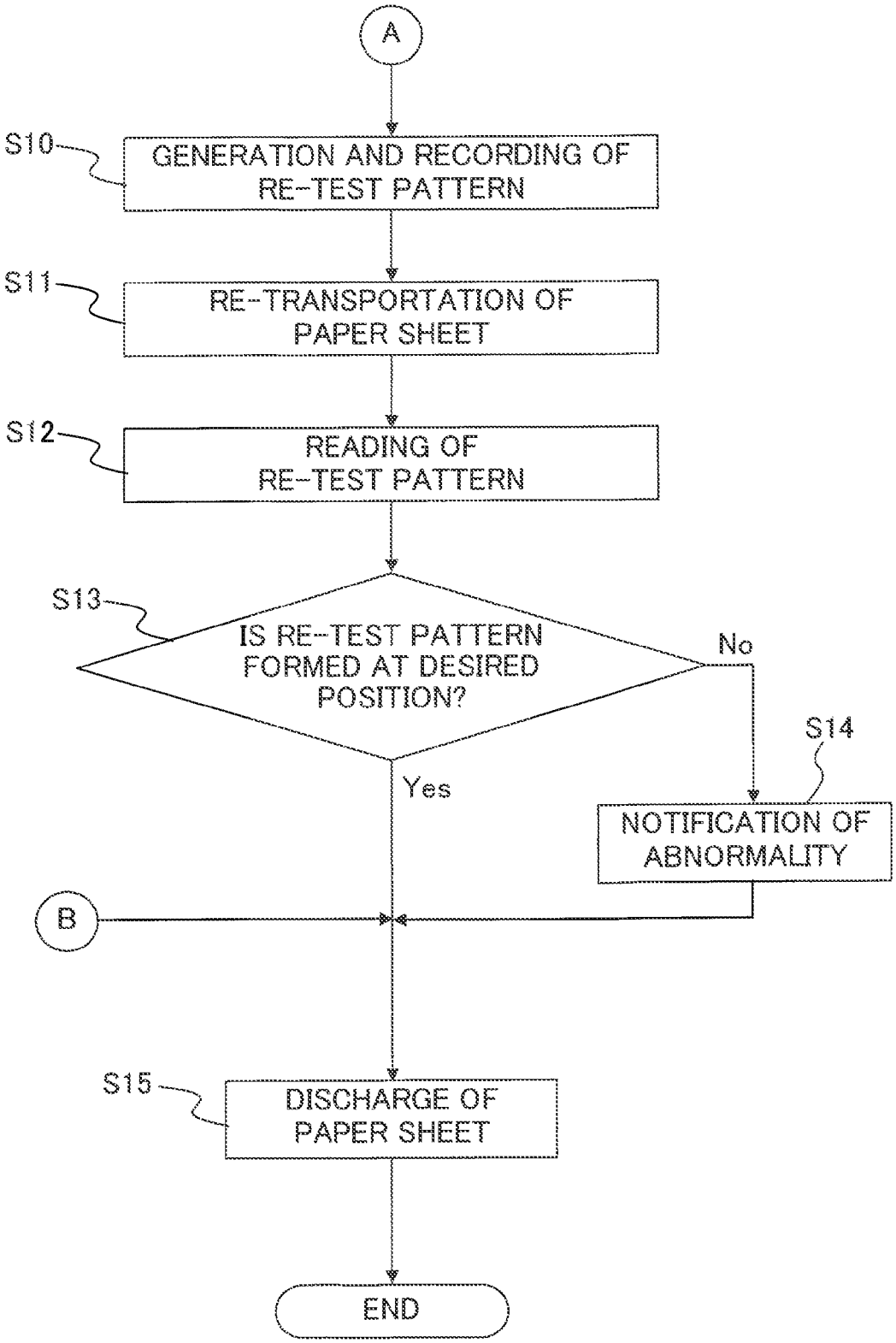

Next, control flow with respect to the discharge inspection of the printer 1 will be explained as follows, with reference to FIGS. 3 and 4.

The controller 100 stands by until the controller 100 receives any discharge inspection command for executing the discharge inspection from the external apparatus 97 (Step S1). When the controller 100 receives a discharge inspection command (YES in S1), the controller 100 executes a test pattern recording process (test pattern recording step) based on the discharge inspection command. Specifically, the transportation controlling circuit 122 drives the paper sheet feeding motor 25M to feed out the paper sheet P (Step S2). Next, the transportation controlling circuit 122 drives the transporting motors 41M to 45M to transport the paper sheet P along the paper sheet transporting path at a predetermined velocity (Step S3). Accompanying with the transportation of the paper sheet P, the image sensor controlling circuit 126 controls the image sensor 28 so as to read the entirety of the paper sheet P (Step S4). Namely, the first reading data is outputted from the image sensor 28 to the controller 100. At this time, the paper sheet length derivation controlling circuit 125 derives the entire length "b" of the paper sheet P which is actually transported (entire length deriving process). Further, when a signal detecting the forward end of the paper sheet P is outputted from the paper sheet sensor 26, the head controlling circuit 121 controls the driver IC 2*d* based on the test pattern data (Step S5). Note that this discharge inspection is executed in a state that any correction value is not stored in the correction value storage section 113. Accordingly, the test pattern K1 is recorded at the predetermined discharge timing. With this, the test pattern K1 is recorded on the first surface P1 of the paper sheet P, as shown in FIG. 3A.

When the test pattern K1 is recorded on the paper sheet P, the controller 100 executes a first reading process (first reading step) for causing the image sensor 28 to read the test pattern K1. Specifically, when the paper sheet sensor 27 outputs a signal detecting the rear end the second side Pb1) of the paper sheet P, the transporting motors 44M and 46M to 48M are controlled by the transportation controlling circuit 122 so as to rotate the pair of transporting rollers 44 in the reverse direction and to drive the pairs of the transporting rollers 46 to 48 (Step S6). With this, the paper sheet P is re-transported to the paper sheet transporting path via the paper sheet re-transporting path. Afterwards, the image sensor controlling circuit 126 controls the image sensor 28 accompanying with the re-transportation of the paper sheet P so as to read the area, on the first surface P1 of the paper sheet P, spanning from the second side Pb1 up to the test pattern K1 (Step S7). Namely, the image sensor 28 outputs the second reading data to the controller 100.

After the first reading process has been completed, the controller 100 executes a first judging process to judge whether or not the position of the test pattern K1 based on the second reading data coincides with the desired position. Specifically, the calculation controlling circuit 124 calculates the first inspection distance b1 based on the second reading data. Afterwards, the judgment controlling circuit 123 judges whether or not the first inspection distance b1 shown in FIG. 3B is same as the set distance a1 shown in FIG. 3A (Step S8). In a case that the distances a1 and b1 are same, the judgment controlling circuit 123 judges that the test pattern K1 is formed at the desired position on the paper sheet P (YES in Step S8), and the procedure proceeds to Step S15. On the other hand, in a case that the distances a1 and b1 are different from each other, the judgment controlling circuit 123 judges that the test pattern K1 is not formed at the desired position on the paper sheet P, namely that the position of the test pattern K1 does not coincide with the desired position (NO in Step S8), and the procedure proceeds to Step S9. Note that when the judgment controlling circuit 123 judges that the test pattern K1 is not formed at the desired position on the paper sheet P, the judgment controlling circuit 123 also judges whether or not the first inspection distance b1 is greater than the set distance a1.

In a case that the test pattern K1 is not formed at the desired position on the paper sheet P, the controller 100 executes a re-test pattern recording process (re-test pattern recording step). Specifically, the calculation controlling circuit 124 calculates a positive or negative correction value for correcting the predetermined discharge timing (Step S9). The calculated correction value is stored in the correction value storage section 113. Then, when the paper sheet sensor 26 outputs a signal detecting the forward end of the paper sheet P, for the first time after the first reading process, the transportation controlling circuit 122 controls the transporting motor 44M to return the rotation direction of the pair of transporting rollers 44 to the normal direction. At this time, the pairs of transporting rollers 41 to 43 and 45 to 48 are continuously driven. Further at this time, the head controlling circuit 121 generates a re-test pattern data for recording the re-test pattern K2. Then, the head controlling circuit 121 controls the driver IC 2*d* based on the re-test pattern data in which the predetermined discharge timing has been corrected (Step S10). With this, as shown in FIG. 3C, the re-test pattern K2 is recorded on the second surface P2 of the paper sheet P. Further, the re-test pattern K2 is recorded before the paper sheet P completely passes beyond the head 2 for the first time after the first reading process.

When the re-test pattern K2 is recorded on the paper sheet P, the controller 100 executes a second reading process (second reading step) for causing the image sensor 28 to read the re-test pattern K2. Specifically, when the paper sheet sensor 27 outputs a signal detecting the rear end (the first side Pa1) of the paper sheet P, the transportation controlling circuit 122 controls the transporting motor 44M to rotate the pair of transporting rollers 44 in the reverse direction (Step S11). With this, the paper sheet P is re-transported to the paper sheet transporting path via the paper sheet re-transporting path. Afterwards, the image sensor controlling circuit 126 controls the image sensor 28 accompanying with the re-transportation of the paper sheet P so as to read the area, on the second surface P2 of the paper sheet P, spanning from the first side Pa1 up to the re-test pattern K2 (Step S12). Namely, the image sensor 28 outputs the third reading data to the controller 100.

After the second reading process has been completed, the controller 100 executes a second judging process to judge whether or not the position of the re-test pattern K2 coincides with the desired position, based on the third reading data. Specifically, the calculation controlling circuit 124 calculates the second inspection distance c1 based on the third reading data. Afterwards, the judgment controlling circuit 123 judges whether or not the second inspection distance c1 shown in FIG. 3D is same as the set distance a1 shown in FIG. 3A (Step S13). In a case that the distances a1 and c1 are same, the judgment controlling circuit 123 judges that the re-test pattern K2 is formed at the desired position on the paper sheet P (YES in Step S13), and the procedure proceeds to Step S15. On the other hand, in a ease that the distances a1 and c1 are different from each other, the judgment controlling circuit 123 judges that the re-test pattern K2 is not formed at the desired position on the paper sheet P, namely that the position of the re-test pattern K2 does not coincide with the desired position (NO in Step S13), and the procedure proceeds to Step S14.

In a case that the re-test pattern K2 is not formed at the desired position on the paper sheet P, the buzzer controlling circuit 127 controls the buzzer 29 so as to notify the user of transportation abnormality (Step S14: notifying process). After this, the procedure proceeds to Step S15.

In Step S15, when the paper sheet sensor 26 outputs a signal detecting the forward end of the paper sheet P, the transportation controlling circuit 122 controls the transporting motor 44M to return the rotation direction of the pair of transporting rollers 44 to the normal direction. At this time, the pairs of transporting rollers 41 to 43 and 45 to 48 are continuously driven. In such a manner, either one of the paper sheet P having the test pattern K1 recorded thereon and the paper sheet P having the test pattern K1 and the re-test pattern K2 recorded thereon is discharged to the paper sheet discharging section 4. Note that in a case that the procedure proceeds from Step S8 to Step S15, since the test pattern K1 is formed at the desired position on the paper sheet P, the paper sheet P having the test pattern K1 recorded thereon is discharged to the paper sheet discharging section 4, without forming the re-test pattern K2 on the paper sheet P (discharging process). With this, it is possible to omit unnecessary inspection of the discharge timing.

Thus, the discharge inspection is completed. In a case that the correction value is calculated in this discharge inspection, the correction value is stored in the correction value storage section 113. Thus, in a ease that an image recording operation for recording an image on a paper sheet P is executed based on a recording command (image data), the head controlling circuit 121 may generate a corrected image data in a similar manner as generating the re-test pattern data and record the image on the paper sheet P based on the corrected image data. By doing so, it is possible to record the image at the desired position on the paper sheet P, thereby making it possible to suppress any lowering in the image quality.

As described above, according to the printer 1 of the embodiment, the re-test pattern K2 is recorded on the second surface P2 of the paper sheet P, before the paper sheet P completely passes beyond the head 2 for the first time after the first reading process. Accordingly, even using the paper sheet P on which the test pattern K1 has been recorded, the number of times for re-transporting the paper sheet P for inspecting the discharge timing becomes twice, thereby shortening the inspection time required for the discharge inspection.

The test pattern K1 is formed at the first portion Pb of the paper sheet P, and the re-test pattern K2 is formed at the second portion Pa of the paper sheet P. In such a manner, by forming the test pattern K1 on one of the first and second portions Pb and Pa of the paper sheet P, and forming the re-test pattern K2 on the other of the first and second portions Pb and Pa, it is possible to form each of the test pattern K1 and the re-test pattern K2 on one of the upstream and downstream sides with respect to the central portion of the paper sheet P along the paper sheet transporting path when forming each of the test pattern K1 and the re-test pattern K2. Therefore, it is possible to secure a time for generating the corrected image data until the re-test pattern K2 is recorded after the test pattern recording process.

Further, by forming the test pattern K1 at the first portion Pb of the paper sheet P and forming the re-test pattern K2 at the second portion Pa of the paper sheet P, it is possible to shorten the spacing distance between the image sensor 28 and the head 2 along the paper sheet transporting path, thereby contributing to the reduction in the apparatus size. Here, such a case is assumed wherein the test pattern K1 is to be formed at the second portion Pa and in the vicinity of the first side Pa1 of the paper sheet P, and that the re-test pattern K2 is to be formed at the first portion Pb and in the vicinity of the second side Pb1 of the paper sheet P. In this case, when recording the re-test pattern K2 on the paper sheet P, it is necessary to read substantially the entirety of the paper sheet P (namely, from the second side Pb1 up to the test pattern K1), with the image sensor 28, before the forward end (the second side Pb1) of the paper sheet P reaches the head 2. Namely, the spacing distance between the image sensor 28 and the head 2 along the paper sheet transporting path becomes great.

Further, in this embodiment, by forming the test pattern K1 at a portion or location, of the first portion Pb, in the vicinity of the second side Pb1 of the paper sheet P and forming the re-test pattern K2 at a portion or location, of the second portion Pa, in the vicinity of the first side Pa1 of the paper sheet P, it is possible to further decrease the spacing distance between the image sensor 28 and the head 2 along the paper sheet transporting path.

Furthermore, with the configuration wherein the controller 100 derives the entire length "b" of the paper sheet P, which is actually transported, in the paper sheet transportation during the test pattern recording process, the correction accuracy of the discharge timing is enhanced. Here, such a case is assumed wherein the first inspection distance b1 is calculated by using a pre-stored entire length of the paper sheet P. In this case, if there were any difference between the pre-stored entire length and the entire length of the paper sheet P which is actually transported, the first inspection distance b1 is affected to an extent corresponding to this difference, thus lowering the correction accuracy of the discharge timing.

Figure 5:
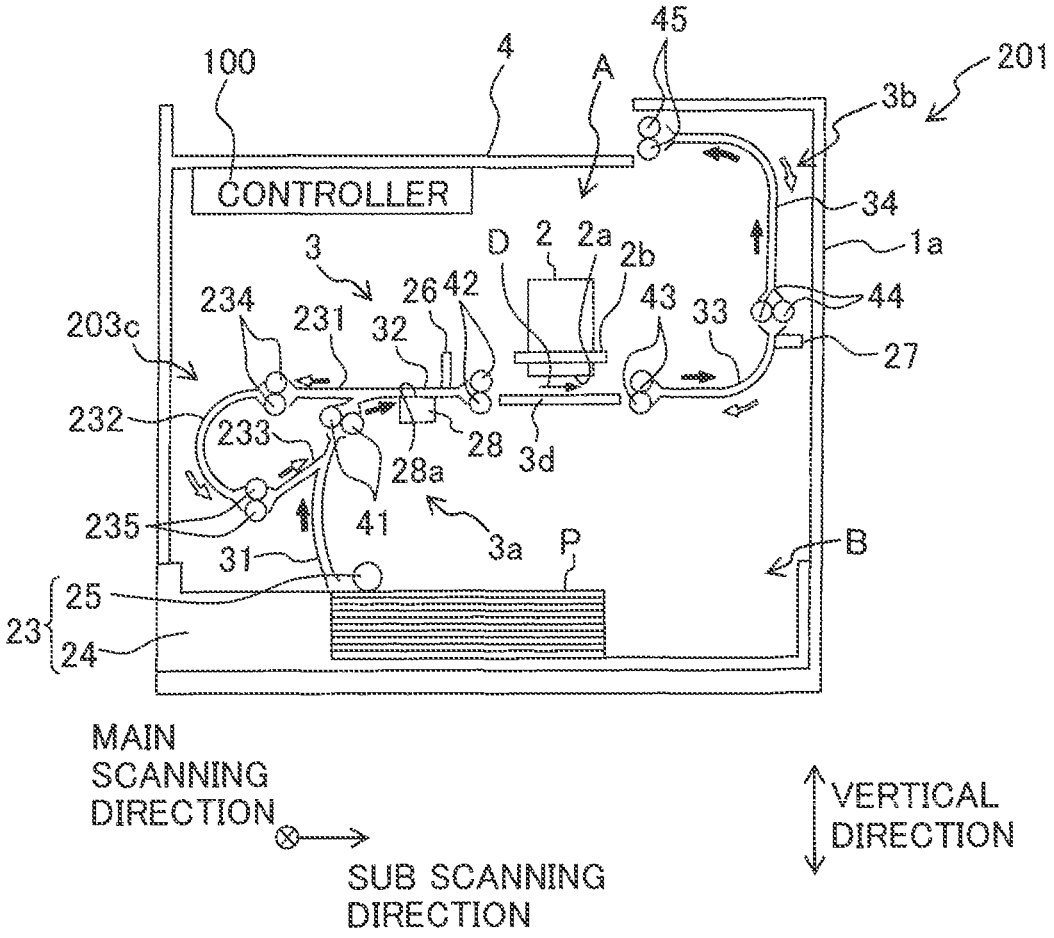
FIG. 5 is a schematic side view showing the inner configuration of an ink-jet printer according to a modification of the recording apparatus of the present teaching.

As a modification, a printer 201 may be provided with a re-transporting guide portion 203*c* which is arranged upstream of the head 2 along the paper sheet transporting path, as shown in FIG. 5. The re-transporting guide portion 203*c* has three guides 231 to 233 and two pairs of transporting rollers 234 and 235. The guide 231 is connected to an intermediate portion of the guide 32. The guide 233 is connected to an intermediate portion of the guide 31. The guide 232 connects these guides 231 and 233. A guide having a shape of letter "U" and connected to the two guides 31 and 32 is defined by the three guides 231 to 233. The paper sheet re-transporting path (second transporting path) is defined by the three guides 231 to 233. The two pairs of transporting roller 234 and 235 are arranged in this order respectively between two adjacent guides among the guides 231 to 233. Further, the two pairs of transporting rollers 234 and 235 are rotated by being driven under the control of the controller 100, and transport the paper sheet P in a direction indicated by white thick arrows in FIG. 5.

In this modification, in a case of re-transporting a paper sheet P having an image (including a test pattern) recorded thereon and when the rear end of the paper sheet P is detected by the paper sheet sensor 27, the three pairs of transporting rollers 42 to 44 are driven to rotate in the reverse direction under the control of the controller 100. Namely, the paper sheet P, which has been transported from the paper sheet feeding section 23 toward the paper sheet discharging section 4 via the recording area is transported in the reverse direction. At this time, the two pairs of transporting rollers 234 and 235 are also driven under the control of the controller 100. Then, when the forward end of the paper sheet P, re-transported to the paper sheet transporting path passing through the paper sheet re-transporting path, is detected by the paper sheet sensor 26, the three pairs of transporting rollers 42 to 44 are driven to rotate in the normal direction. With this, it is possible to re-transport the paper sheet P and to inverse the front and back surfaces of the paper sheet P, in a similar manner as in the embodiment described above. Note that in this modification, the same effects as in the embodiment can be obtained by executing the control similar to that described above, except the manner for re-transporting the paper sheet P and for inverting the back and front surfaces thereof.

Although the preferred embodiment of the present teaching has been explained as above, the present teaching is not limited only to the embodiment described above, and various kinds of modification and/or change can be made to the embodiment within the scope described in the appended claims. For example, although in the above-described embodiment and modification, the re-test pattern data and the corrected image data for which the same correction value is considered are generated at all of the discharge ports 2*a*1, it is allowable to calculate an correction value for each of the discharge ports 2*a*1 and to generate a re-test pattern data and a corrected image data having the corrected discharge timing and generated for each of the discharge ports 2*a*1. By doing so, the image quality is further enhanced.

The test pattern K1 may be formed to be away from the second side Pb1 and the re-test pattern K2 may be formed to be away from the first side Pa1, under the condition that the test pattern K1 is formed at one of the first and second portions Pb and Pa of the paper sheet P and that the re-test pattern K2 is formed at the other of the first and second portions Pb and Pa. Alternatively, for example, the test pattern K1 and the re-test pattern K2 may be recorded at the same location of one of the first portion Pb and the second portion Pa. Still alternatively, the test pattern K1 and the re-test pattern K2 may be formed at the central portion of the paper sheet P along the paper sheet transporting path.

Further, in the above-described embodiment and modification, at least one of the first and second judging processes may be omitted. In addition, the entire length of the paper sheet P may be stored in advance. Namely, the entire length deriving process may be omitted. Furthermore, the notifying mechanism such as the buzzer 29 may be omitted. In such a case, the notifying process may be omitted. Moreover, any transportation abnormality may be notified to the user by ways of showing in a display as the notifying mechanism, instead of the buzzer 29. Further, the paper sheet sensor 27 may be omitted. In such a case, the position of the paper sheet P may be detected by the number of rotations of the pair of transporting rollers, etc.

The present teaching is applicable to both of the line-type head and serial-type head, and is also applicable to a facsimile machine, copying machine, etc., without being limited to the printers. Further, provided that an apparatus to which the present invention is to be applied is a recording apparatus configured to record an image, the present teaching is applicable to any kinds of recording apparatuses such as recording apparatuses of the laser type, the thermal type, etc. The recording medium to be usable with the present teaching is not limited only to the papers sheet P, and may be of various kinds of recording media on which recording can be performed, provided that the recording media have flexibility.

What is claimed is:

1. A recording apparatus comprising:

a transporting mechanism configured to transport a recording medium along a first transporting path;

a recording head configured to record an image on the recording medium which is transported by the transporting mechanism;

a reading unit which is configured to read the recording medium and which is arranged upstream of the recording head along the first transporting path and on a side opposite to the recording head, with the first transporting path intervened between the reading unit and the recording head;

a re-transporting mechanism configured to re-transport the recording medium to return to an upstream portion of the first transporting path located upstream of the reading unit with a rear end, of the recording medium which has been transported by the transporting mechanism to a downstream portion of the first transporting path located downstream of the recording head, as a forward end in the re-transportation, via a second transporting path different from the first transporting path, thereby performing re-transportation of the recording medium to an upstream portion, of the transporting mechanism, located upstream of the reading unit in a state that front and back surfaces of the recording medium are inverted;

a sensor arranged upstream of the recording head along the first transporting path and configured to detect a forward end of the recording medium which is transported by the transporting mechanism; and a controller configured to control the recording head, the reading unit, the transporting mechanism and the re-transporting mechanism, wherein the controller is configured to execute:

a test pattern recording process in which a test pattern is recorded on a first surface of the recording medium based on a detection timing at which the sensor detects the forward end of the recording medium by controlling the transporting mechanism and the recording head;

a first reading process, in which the recording medium having the test pattern recorded on the first surface thereof is re-transported to the reading unit by controlling the re-transporting mechanism and the transporting mechanism and the first surface on which the test pattern has been recorded is read by controlling the reading unit;

a re-test pattern recording process, in which a re-test pattern is recorded by controlling the transporting mechanism and the recording head, at a recording corrected based on a reading data read in the first reading process, on a second surface on a side opposite to the first surface of the recording medium based on the detection timing, before the recording medium which has been read in the first reading process completely passes beyond the recording head for a first time after the first reading process; and a second reading process, in which the recording medium having the re-test pattern recorded on the second surface thereof is re-transported by controlling the re-transporting mechanism and the transporting mechanism and the second surface on which the re-test pattern has been recorded is read by controlling the reading unit.

2. The recording apparatus according to claim 1, wherein in the test pattern recording process, the test pattern is recorded at one of a first portion and a second portion of the recording medium being transported along the first transporting path, the first portion being located upstream of a central portion of the recording medium, and the second portion being located downstream of the central portion, and in the re-test pattern recording process, the re-test pattern is recorded at the other of the first and second portions of the recording medium.

3. The recording apparatus according to claim 2, wherein the test pattern is recorded at the first portion in the test pattern recording process, and the re-test pattern is recorded at the second portion in the re-test pattern recording process.

4. The recording apparatus according to claim 3, wherein the test pattern is recorded in the vicinity of an end portion, of the first portion, located farthest from the second portion, and the re-test pattern is recorded in the vicinity of an end portion, of the second portion, located farthest from the first portion.

5. The recording apparatus according to claim 1, wherein the controller is configured to further execute a first judging process of judging whether or not a position of the test pattern read in the first reading process coincides with a desired position determined by a recording timing based on the detection timing at which the forward end of the recording medium is detected by the sensor, after performing the first reading process and before performing the re-test pattern recording process, and the controller is configured to execute, under a condition that the position of the test pattern coincides with the desired position in the first judging process, a discharge process in which the recording medium having the test pattern recorded thereon is discharged without recording the re-test pattern on the recording medium by controlling the transporting mechanism.

6. The recording apparatus according to claim 5, further comprising a notifying mechanism configured to notify transportation abnormality of the recording medium, wherein the controller is configured to further execute a second judging process of judging whether or not a position of the re-test pattern read in the second reading process coincides with the desired position determined by the recording timing, after performing the second reading process, and the controller is configured to execute a notifying process in which the transportation abnormality is notified to a user by controlling the notifying mechanism, under a condition that the position of the re-test pattern does not coincide with the desired position in the second judging process.

7. The recording apparatus according to claim 1, wherein the controller is configured to further execute an entire length deriving process of deriving an entire length of the recording medium along the first transporting path, based on a reading data obtained by reading the recording medium along the first transporting path with the reading unit when transporting the recording medium for the test pattern recording process, and in the re-test pattern recording process, the controller is configured to correct the recording timing of the re-test pattern based on a position of the test pattern read in the first reading process and on the entire length of the recording medium along the first transporting path derived in the entire length deriving process.

8. A storage medium storing a computer-executable instructions that, when executed by a processor of a computer, cause a recording apparatus to execute the following processes, the recording apparatus including: a transporting mechanism configured to transport a recording medium along a first transporting path; a recording head configured to record an image on the recording medium which is transported by the transporting mechanism; a reading unit which is configured to read the recording medium and which is arranged upstream of the recording head along the first transporting path and on a side opposite to the recording head, with the first transporting path intervened between the reading unit and the recording head; a re-transporting mechanism configured to re-transport the recording medium to return to an upstream portion of the first transporting path located upstream of the reading unit with a rear end, of the recording medium which has been transported by the transporting mechanism to a downstream portion of the first transporting path located downstream of the recording head, as a forward end in the re-transportation, via a second transporting path different from the first transporting path, thereby performing re-transportation of the recording medium to an upstream portion, of the transporting mechanism, located upstream of the reading unit in a state that front and back surfaces of the recording medium are inverted; and a sensor arranged upstream of the recording head along the first transporting path and configured to detect a forward end of the recording medium which is transported by the transporting mechanism, the processes which the recording apparatus is caused to execute by the instruction comprising:

a test pattern recording process in which a test pattern is recorded on a first surface of the recording medium based on a detection timing at which the sensor detects the forward end of the recording medium by controlling the transporting mechanism and the recording head;

a first reading process, in which the recording medium having the test pattern recorded on the first surface thereof is re-transported to the reading unit by controlling the re-transporting mechanism and the transporting mechanism and the first surface on which the test pattern has been recorded is read by controlling the reading unit;

a re-test pattern recording process, in which a re-test pattern is recorded by controlling the transporting mechanism and the recording head, at a recording timing corrected based on a reading data read in the first reading process, on a second surface on a side opposite to the first surface of the recording medium based on the detection timing, before the recording medium which has been read in the first reading process completely passes beyond the recording head for a first time after the first reading process; and a second reading process, in which the recording medium having the re-test pattern recorded on the second surface thereof is re-transported by controlling the re-transporting mechanism and the transporting mechanism and the second surface on which the re-test pattern has been recorded is read by controlling the reading unit.

9. The storage medium according to claim 8, wherein in the test pattern recording process, the test pattern is recorded at one of a first portion and a second portion of the recording medium being transported along the first transporting path, the first portion being located upstream of a central portion of the recording medium, and the second portion being located downstream of the central portion, and in the re-test pattern recording process, the re-test pattern is recorded at the other of the first and second portions of the recording medium.

10. The storage medium according to claim 9, wherein the test pattern is recorded at the first portion in the test pattern recording process, and the re-test pattern is recorded at the second portion in the re-test pattern recording process.

11. The storage medium according to claim 10, wherein the test pattern is recorded in the vicinity of an end portion, of the first portion, located farthest from the second portion, and the re-test pattern is recorded in the vicinity of an end portion, of the second portion, located farthest from the first portion.

12. The storage medium according to claim 8, wherein the instruction causes the recording apparatus to further execute an entire length deriving process of deriving an entire length of the recording medium along the first transporting path, based on a reading data obtained by reading the recording medium along the first transporting path with the reading unit when transporting the recording medium for the test pattern recording process, and in the re-test pattern recording process, the instruction causes the recording apparatus to correct the recording timing of the re-test pattern based on a position of the test pattern read in the first reading process and on the entire length of the recording medium along the first transporting path derived in the entire length deriving process.

13. A control method for controlling a recording apparatus including: a transporting mechanism configured to transport a recording medium along a first transporting path; a recording head configured to record an image on the recording medium which is transported by the transporting mechanism; a reading unit which is configured to read the recording medium and which is arranged upstream of the recording head along the first transporting path and on a side opposite to the recording head, with the first transporting path intervened between the reading unit and the recording head; are transporting mechanism configured to re-transport the recording medium to return to an upstream portion of the first transporting path located upstream of the reading unit with a rear end, of the recording medium which has been transported by the transporting mechanism to a downstream portion of the first transporting path located downstream of the recording head, as a forward end in the re-transportation, via a second transporting path different from the first transporting path, thereby performing re-transportation of the recording medium to an upstream portion, of the transporting mechanism, located upstream of the reading unit in a state that front and back surfaces of the recording medium are inverted; and a sensor arranged upstream of the recording head along the first transporting path and configured to detect a forward end of the recording medium which is transported by the transporting mechanism, the control method comprising:

controlling the transporting mechanism and the recording head to record a test pattern on a first surface of the recording medium based on a detection timing at which the sensor detects the forward end of the recording medium; controlling the re-transporting mechanism and the transporting mechanism to re-transport the recording medium having the test pattern recorded on the first surface thereof to the reading unit and controlling the reading unit to read the first surface on which the test pattern has been recorded;

controlling the transporting mechanism and the recording head to record a re-test pattern at a recording timing corrected based on a reading data read by the reading unit, on a second surface on a side opposite to the first surface of the recording medium based on the detection timing, before the recording medium which has been read by the reading unit completely passes beyond the recording head for a first time after having been read by the reading unit; and controlling the re-transporting mechanism and the transporting mechanism to re transport the recording medium having the re-test pattern recorded on the second surface thereof and controlling the reading unit to read the second surface on which the re-test pattern has been recorded.

14. The control method according to claim 13, wherein the test pattern is recorded at one of a first portion and a second portion of the recording medium being transported along the first transporting path, the first portion being located upstream of a central portion of the recording medium, and the second portion being located downstream of the central portion, and the re-test pattern is recorded at the other of the first and second portions of the recording medium.

15. The control method according to claim 14, wherein the test pattern is recorded at the first portion, and the re-test pattern is recorded at the second portion.

16. The control method according to claim 15, wherein the test pattern is recorded in the vicinity of an end portion, of the first portion, located farthest from the second portion, and the re-test pattern is recorded in the vicinity of an end portion, of the second portion, located farthest from the first portion.

17. The control method according to claim 13, further comprising:

deriving an entire length of the recording medium along the first transporting path, based on a reading data obtained by reading the recording medium along the first transporting path with the reading unit when transporting the recording medium for the test pattern recording process; and correcting the recording timing of the re-test pattern based on a position of the test pattern read by the reading unit and on the derived entire length of the recording medium along the first transporting path.

* * * * *